US008608159B2

(12) United States Patent
Takeuchi et al.

(10) Patent No.: US 8,608,159 B2
(45) Date of Patent: Dec. 17, 2013

(54) RECORDING APPARATUS

(75) Inventors: Toshiki Takeuchi, Yokohama (JP); Haruo Uchida, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/617,043

(22) Filed: Sep. 14, 2012

(65) Prior Publication Data

US 2013/0009356 A1 Jan. 10, 2013

Related U.S. Application Data

(62) Division of application No. 12/388,622, filed on Feb. 19, 2009, now Pat. No. 8,297,614.

(30) Foreign Application Priority Data

Feb. 20, 2008 (JP) ..... 2008-039045

(51) Int. Cl.
*B65H 1/00* (2006.01)

(52) U.S. Cl.
USPC ..... 271/145; 271/162; 271/164; 271/213; 399/393

(58) Field of Classification Search
USPC ..... 271/145, 162, 164, 213, 207; 399/393, 399/405
See application file for complete search history.

(56) References Cited

U.S. PATENT DOCUMENTS

| | | | | |
|---|---|---|---|---|
| 5,241,353 | A | 8/1993 | Maeshima et al. | |
| 6,106,178 | A | 8/2000 | Chiu | |
| 6,382,617 | B1 | 5/2002 | Yen et al. | |
| 6,848,685 | B2 | 2/2005 | Katsuyama | |
| 6,890,071 | B2 | 5/2005 | Khormaei et al. | |
| 7,052,197 | B2 | 5/2006 | Bowen et al. | |
| 7,108,368 | B2 | 9/2006 | Saito et al. | |
| 7,243,915 | B2 | 7/2007 | Wong et al. | |
| 7,374,281 | B2 | 5/2008 | Saito et al. | |
| 7,410,164 | B2 | 8/2008 | Koide et al. | |
| 7,658,490 | B2 | 2/2010 | Hwang et al. | |
| 7,815,304 | B2 * | 10/2010 | Ahn | 347/108 |
| 7,959,149 | B2 * | 6/2011 | Matsumoto | 271/162 |
| 8,235,614 | B2 * | 8/2012 | Takata et al. | 400/693 |
| 8,503,921 | B2 * | 8/2013 | Kobayashi | 399/393 |
| 2004/0169327 | A1 | 9/2004 | Swayze et al. | |
| 2005/0094227 | A1 | 5/2005 | Hwang et al. | |
| 2005/0201792 | A1 | 9/2005 | Park et al. | |
| 2009/0152803 | A1 | 6/2009 | Matsumoto | |

FOREIGN PATENT DOCUMENTS

| | | |
|---|---|---|
| JP | 05-069957 A | 3/1993 |
| JP | 07-101599 A | 4/1995 |
| JP | 05-179021 A | 7/2005 |

* cited by examiner

*Primary Examiner* — Luis A Gonzalez
(74) *Attorney, Agent, or Firm* — Fitzpatrick, Cella, Harper & Scinto

(57) ABSTRACT

A recording apparatus includes a cassette having a stacking region for stacking recording materials mounted to main assembly of the recording apparatus; a feeder for feeding the recording material stacked to the cassette; a sheet discharge portion for sheet discharging the recording material having been subjected to a recording operation; a tray movable between a first position where the recording material is incapable of being discharged from the sheet discharge portion and a second position where the recording material is capable of being discharged from a main assembly of the recording apparatus; a holding portion, disposed on the tray, for holding the recording material discharged when the tray is at the second position; an auxiliary portion disposed on the tray and capable of stacking the recording material with the stacking region when the tray is at the second position.

8 Claims, 7 Drawing Sheets

RECORDING APPARATUS

RELATED APPLICATIONS

This application is a divisional of application Ser. No. 12/388,622, filed Feb. 19, 2009. This application claims benefit of that application under 35 U.S.C. §120, and claims benefit under 35 U.S.C. §119 of Japanese patent application no. 2008-039045 filed Feb. 20, 2008. The entire contents of each of the mentioned prior applications are incorporated herein by reference.

BACKGROUND OF THE INVENTION

1. Field of the Invention

The present invention relates to a recording device for recording letters, images or the like.

2. Description of Related Art

Referring first to FIG. 15, it is a sectional view of a conventional recording device.

As shown in this Figure, a sheet feeding cassette 101 provided in a lower portion of the main assembly of the recording apparatus stores a number of recording sheets, which are fed out one by one, as is widely used. The sheet feeding cassette 101 is slidable to and fro, and the user loads the recording material at the front side of the recording device. The feeding path for the recording material is U-fold, and U-turn feeding rollers 102, 103 feed the sheet fed toward the rear, toward the front side to supply it for subjecting to the recording operation of the recording head 104. The recording material having been subjected to the recording operation is fed to the front side of the recording device by the sheet discharging roller 105 and then to the sheet discharge tray 106.

With such a structure, the user can take the printed sheets at the front side of the recording device.

In this case, the sheet feeding cassette 101 and the sheet discharge tray 106 are both disposed at the front side of the recording device, they are close to each other, and various structures are proposed for providing a sufficient space therefor, simplicity of the structure or an operativity.

However, the conventional structure in which the sheet feeding cassette and the sheet discharge tray are both disposed at the front side may involve the problems as follows.

From the standpoint of downsizing the apparatus, the areas for the sheet feeding cassette and the sheet discharge tray are common as much as possible. However, from the standpoint of operationality, the users operations do not interfere under the user's operating conditions. For example, the sheet discharge tray should not disposed in the region occupied when the sheet feeding cassette is slid to and fro, or the region required for loading the recording material. Otherwise, the user has to retract the sheet discharge tray in order to load the recording material. It is desirable that sheet feeding cassette and the sheet discharge tray do not interfere with each other particularly in the sliding direction of the sheet feeding cassette. As a result, the height required by the recording device is at least a sum of the heights of the sheet feeding cassette and the sheet discharge tray. In addition, a height is required for a number of sheets stacked on the sheet discharge tray. For such reasons, the downsizing of the recording apparatus is difficult.

On the other hand, if the priority is put on the downsizing in the height direction at the cost of the operativity by disposing the sheet feeding cassette and the sheet discharge tray are provided at the same level, it is not possible to extend the sheet feeding cassette since the sheet discharge tray is disposed at the front side of the sheet feeding cassette. Therefore, the size of the sheet feeding cassette has to be the same as the depth of the main assembly of the recording apparatus. This results in the difficulty in providing the main assembly of the recording apparatus having a small depth and the usability of large size recording materials.

SUMMARY OF THE INVENTION

Accordingly, it is a principal object of the present invention to provide a recording apparatus satisfying a compactness and accommodatability with high operativity.

According to an aspect of the present invention, there is provided a recording apparatus comprising a cassette having a stacking region for stacking recording materials mounted to main assembly of said recording apparatus; a feeder for feeding the recording material stacked to said cassette; a sheet discharge portion for sheet discharging the recording material having been subjected to a recording operation; a tray movable between a first position where the recording material is incapable of being discharged from said sheet discharge portion and a second position where the recording material is capable of being discharged from a main assembly of said recording apparatus; a holding portion, disposed on said tray, for holding the recording material discharged when said tray is at the second position; and an auxiliary portion disposed on said tray and capable of stacking the recording material with the stacking region when said tray is at the second position.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Hereafter, the preferred embodiments of the present invention will be described with reference to the appended drawings.

(Embodiment 1)

Next, referring to FIGS. 1-6, the recording apparatus in the first preferred embodiment of the present invention will be described.

Figure 1:
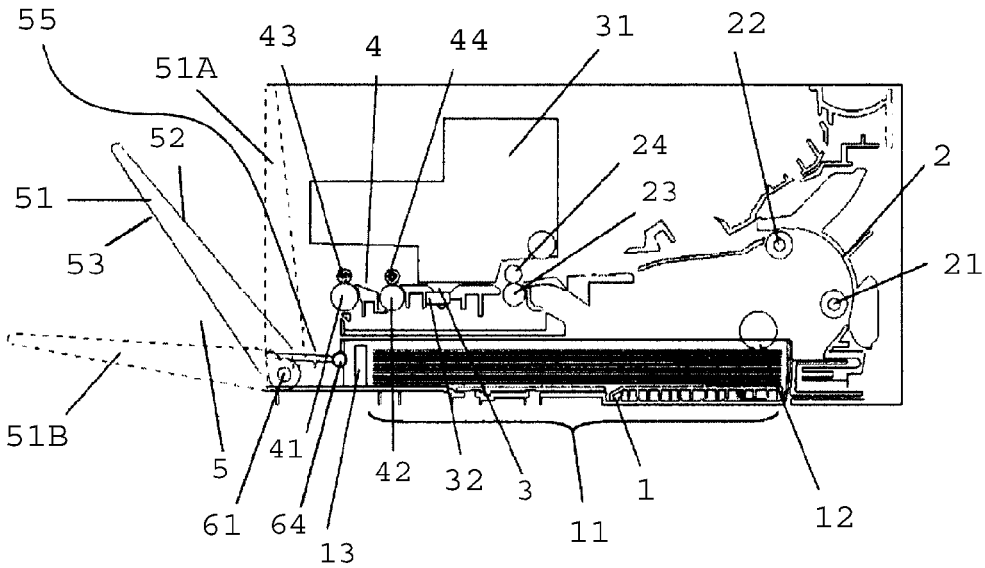
FIG. 1 is a schematic sectional view illustrating a recording apparatus according to a first embodiment of the present invention.

Referring to FIG. 1, the recording apparatus is provided with a removable sheet feeder cassette 1, which is disposed in the bottom portion of the main assembly of the recording apparatus. The sheet feeder cassette 1 can be slid into, or slid out of, the bottom portion of the main assembly of the recording apparatus. It is provided with a recording sheet supporting primary portion 11, on which a large number of sheets of recording medium (which hereafter will be referred to simply as recording sheet) can be horizontally stored in layers. The sheet feeder cassette 1 is also provided with a recording sheet regulating plate 13, which is disposed at the front end (left end in FIG. 1) of the recording sheet supporting primary portion 11. The recording sheet regulating plate 13 positions recording sheets on a preset area of the recording sheet supporting primary portion 11, by regulating in position the trailing end of each recording sheet as recording sheets are inserted into the sheet feeder cassette 1.

The recording apparatus is provided with a separating-and-feeding portion made up of a sheet feeding roller 12 and an unshown sheet separating means. The separating-and-feeding portion is located in the adjacencies of the recording sheet feeding end of the sheet feeder cassette 1. Thus, the recording sheets stored in layers on the recording sheet supporting primary portion 11 are fed one by one into the main assembly of the recording apparatus from the sheet feeder cassette 1. After each recording sheet is fed into the main assembly, it is conveyed further through the main assembly by a pair of sheet conveyance rollers 21 and 22, in such a manner that as it is conveyed, it changes in direction by 180 degrees. More specifically, each recording sheet is fed into the main assembly of the recording apparatus so that it advances rearward of the main assembly. Then, it is convey through a U-turn portion of the recording sheet conveyance path by a pair of U-turn conveyance rollers 21 and 22. As a result, the direction in which the recording sheet advances changes from the rearward direction of the recording apparatus to the frontward direction of the recording apparatus.

After the recording sheet is changed in the direction of its movement by the U-turn portion of the recording sheet conveyance path, it is conveyed further (frontward) by a pair of rollers 23 and 24 located in the adjacencies of the exit end of the U-turn portion 2 so that it enters a recording portion 3. The roller 23 is a sheet conveying roller, whereas the roller 24 is a pinch roller. The U-turn portion 2, sheet conveying roller 23, and pinch roller 24 make up the recording medium conveying portion.

The recording portion 3 has: a platen 32 which supports a recording sheet from the back side of the recording sheet; and a recording head 31 which records letters, images, etc., on the recording sheet. The recording head 31 is a so-called ink jet recording head. It records on the recording sheet supported from its back side by the platen 32, by ejecting droplets of ink in response to image signals inputted into the recording head, while being made to shuttle in the widthwise direction of the recording sheet by a motor.

The recording head 31 has ink ejecting holes (orifices), ink passages, energizing portions, and energy generating portions. Each energizing portion is a part of the corresponding ink passage. Each of energy generating portions is for generating the energy for ejecting a portion of the ink in the corresponding energizing portion, in the form of a droplet, through the corresponding ink ejecting hole (orifice). The methods used by the energy generating portion may be classified into roughly two types. One type uses an electro-mechanical transducer, such as a piezoelectric element. The other type uses an electro-thermal transducer, for example, a heat generation element having a heat generating resistor. An ink jet recording head which uses thermal energy to eject liquid is advantageous over an ink jet recording head which uses mechanical energy to eject liquid, because the employment of electro-thermal transducers makes it possible to arrange in a higher density the ink ejecting holes (orifice), from which ink droplets are ejected out, than the employment of electro-mechanical transducers. Moreover, the employment of electro-thermal transducers makes it easier to manufacture a small ink jet recording head, and also, to arrange ink jet recording heads in higher density. Further, it reduces the cost for manufacturing an ink jet recording head. Thus, an ink jet recording head which uses electro-thermal transducers is widely used.

Although this is not shown in FIG. 1, the recording apparatus in this embodiment is provided with a pump for suctioning ink out of the recording head 31 to restore the recording head 31 in ink ejecting performance. It is also provided with a cap for preventing the ink in the recording head 31 from drying up, a blade for cleaning the surface of the recording head 31, at which the ink ejecting holes open, that is, the areas adjacent to the openings of the ink ejecting holes.

Further, the main assembly of the recording apparatus is provided with a recording sheet discharging portion 4, which is on the downstream side of the recording portion 3 in terms of the recording sheet conveyance direction. The recording sheet discharging portion 4 has: a pair of discharge rollers 41 and 42, which are rotationally driven; a pair of spur rollers 43 and 44, which are rotated by the movement of the recording sheet, while being kept pressed upon the recording sheet; and a recording sheet delivery portion 5 (delivery tray), which holds discharged recording sheets. In order to prevent the spur rollers 43 and 44 from leaving pressure marks, ink marks, etc., on the recording sheet immediately after recording, that is, before the ink on the recording sheet dries, the spur rollers 43 and 44 are shaped like a circular saw with sharp teeth (sharply pointed projections). The discharged sheet holding portion 5 has: a discharged recording sheet catching plate 55; and a tray 51 which functions as an extension to the discharged recording sheet catching plate 55 to hold discharged recording sheets.

The tray 51 is rotatable about an axle 61, with which the tray 51 itself or sheet feeder cassette 1 is provided. The axle 61 is positioned at the same level as the sheet feeder cassette 1. The discharged recording sheet catching plate 55 is rotatable about an axle 64, with which the discharged recording sheet catching plate 55 itself or the sheet feeder cassette 1 is provided; the discharged recording sheet catching plate 55 is attached to the sheet feeder cassette 1.

Figure 2:
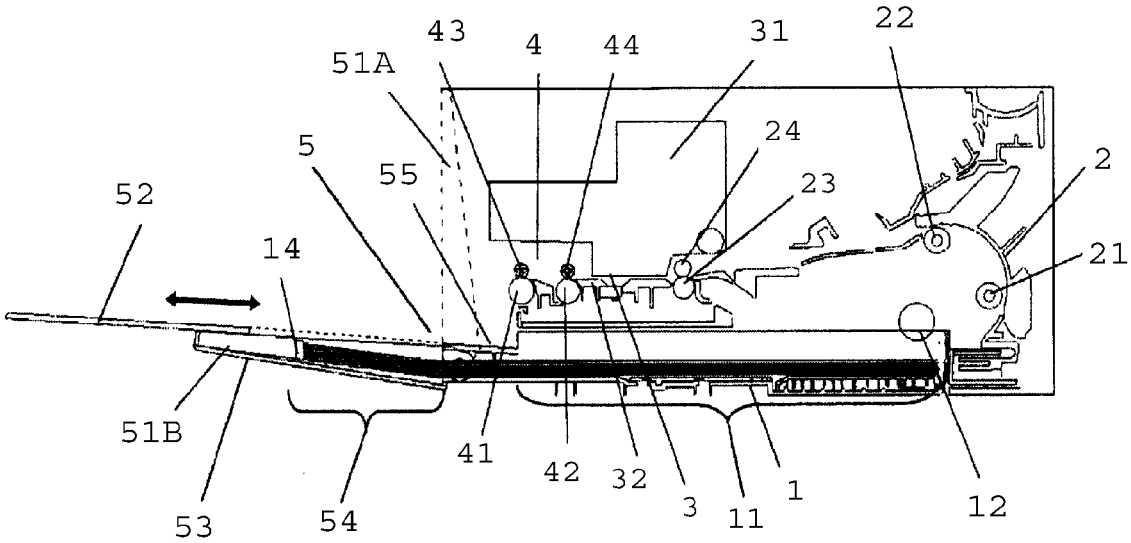
FIG. 2 is a schematic sectional view illustrating a state in which the tray of the recording device shown in FIG. 2.

Next, referring to FIG. 2, the surface of the tray 51, which faces outward of the recording apparatus when the tray 51 is in its closed position (first position) designated by a referential code 51A, is provided with a front cover 53, which serves as a part of the external wall of the main assembly of the recording apparatus. The opposite surface of the tray 51 from the front cover 53 is provided with a discharged recording sheet holding portion 52, which holds recording sheets as they are discharged from the main assembly of the recording apparatus. The discharged recording sheet holding portion 52 is on the recording sheet discharging side of the main assembly of the recording apparatus. Also referring to FIG. 2, the discharged recording sheet holding portion 52 is attached to the tray 51 in such a manner that it can be slidingly moved relative to the front cover 53. Further, the tray 51 is provided with a recording sheet supporting auxiliary portion 54, which is between the discharged recording sheet holding portion 52 and front cover 53. The tray 51 and recording sheet supporting auxiliary portion 54 are structured so that when the tray 51 is in its open position as shown in FIG. 2, the recording sheet supporting surface of the recording sheet supporting auxiliary portion 54 is level with the recording sheet holding surface of the recording sheet supporting primary portion 11 of the sheet feeder cassette 1. Thus, the recording sheet supporting primary and auxiliary portions 11 and 54 can be integrally used to store recording sheets in layers.

Incidentally, the tray 51 shown in FIG. 2 is not extendable. However, the tray 51, which cannot be extended, is not long enough to satisfactorily support discharged recording sheets, it may be replaced with a tray which is extendable in multiple stages.

Next, referring to FIGS. 1-4, the operation of the tray 51 will be described.

Figure 3:
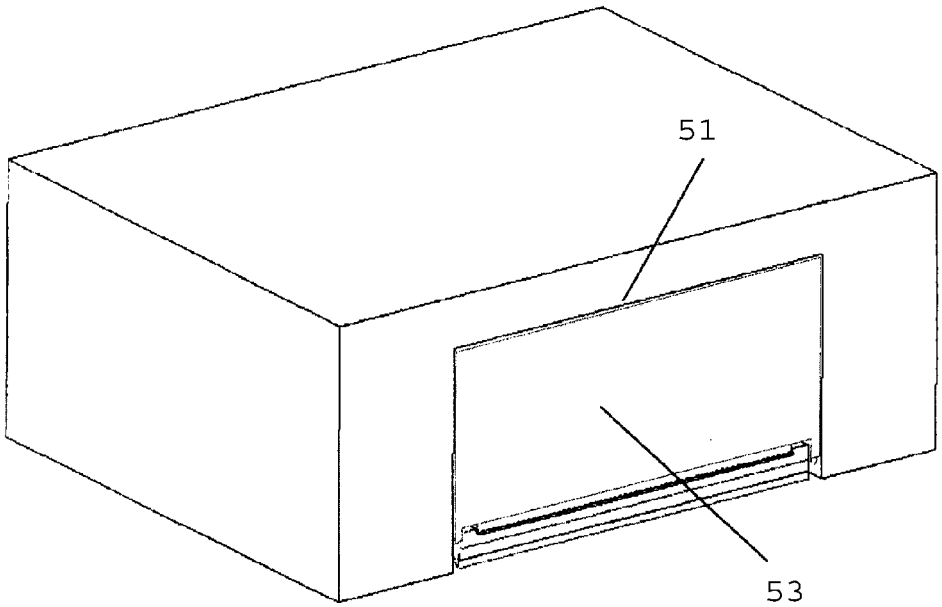
FIG. 3 is a perspective view of an outer appearance of the recording apparatus shown in FIG. 1 in the state in which the tray is closed.

The recording apparatus is structured so that when the tray 51 is not in use, it can be rotationally moved into the closed position, indicated by the referential code 51A, in which the front cover 53 is level with the external wall (front wall) of the main assembly of the recording apparatus. That is, the tray 51 is designed so that not only can the tray 51 be compactly stored, but also, it is satisfactory in terms of the appearance of the recording apparatus. FIG. 3 is an external perspective view of the recording apparatus when its tray 51 is in its stored position.

Figure 4:
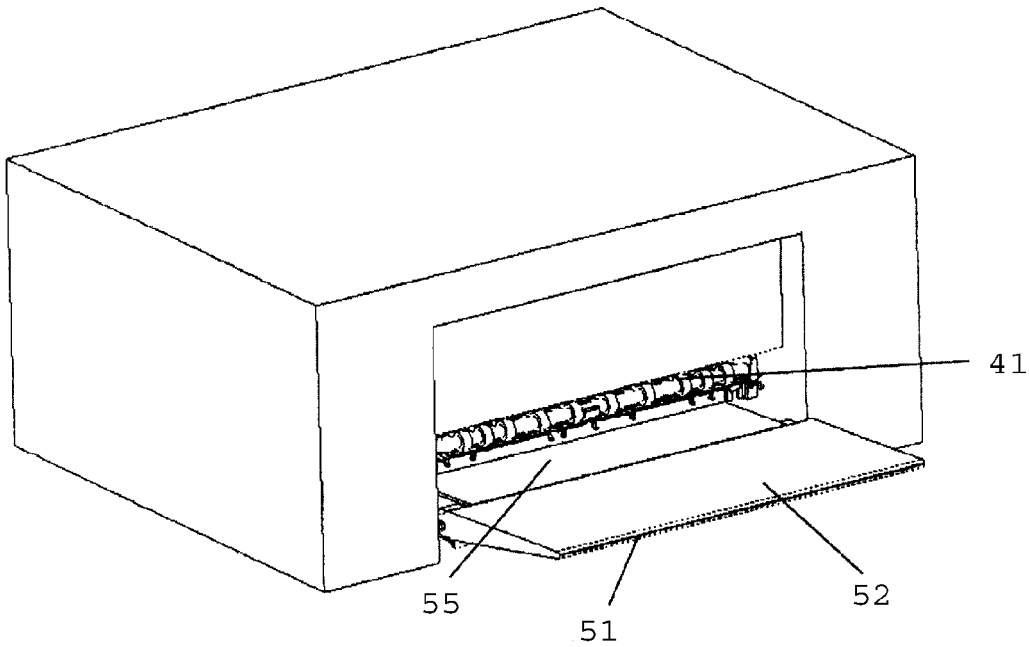
FIG. 4 is a perspective view of an outer appearance illustrating the state in which the tray of the recording device shown in FIG. 1 is open.

Further, the main assembly of the recording apparatus is provided with a tray moving mechanism (unshown), which automatically moves the tray 51 from its closed position indicated by the referential code 51A, into its open position (second position) indicated by a referential code 51B, when the apparatus is used for a recording operation. The tray moving mechanism is structured so that as the recording sheets begin to be fed into the main assembly of the recording apparatus while being separated, or as a recording start signal is inputted into the recording apparatus, the tray 51 is automatically moved into its open position. The tray moving mechanism rotationally moves the tray 51 into its opening position before a recording sheet discharging operation begins. As the tray 51 is rotationally moved into the open position, the discharged recording sheet holding portion 52 of the tray 51 connects to the discharged recording sheet catching plate 55 in such a manner that its recording sheet supporting surface becomes level with the recording sheet supporting surface of the discharged recording sheet catching plate 55 to make it possible for the discharged recording sheets to be smoothly moved onto the combination of the discharged recording sheet holding portion 52 and discharged recording sheet catching plate 55, to be stacked thereon. FIG. 4 is an external perspective view of the recording apparatus, the tray 51 of which has been opened to ready the apparatus to catch and hold discharged recording sheets by the combination of the discharged recording sheet catching plate 55 and the discharged recording sheet holding portion 52 of the tray 51.

The tray moving mechanism for automatically opening the tray 51 may be structured so that the latch for holding the tray 51 is automatically released by a driving force source, such as a solenoid switch, which operates in response to a recording start signal, or so that the linkage, with which the tray 51 is provided, operates in the direction to push open the tray 51, by the movement of the recording sheet discharging rollers 41 and 42. In the case of this embodiment, the recording apparatus is structured so that the tray 51 automatically opens. However, this embodiment is not intended to limit the present invention in scope. That is, the recording apparatus may be structured so that the tray 51 is to be manually opened with the use of a handle, or the like, with which the tray 51 is provided.

Figure 5:
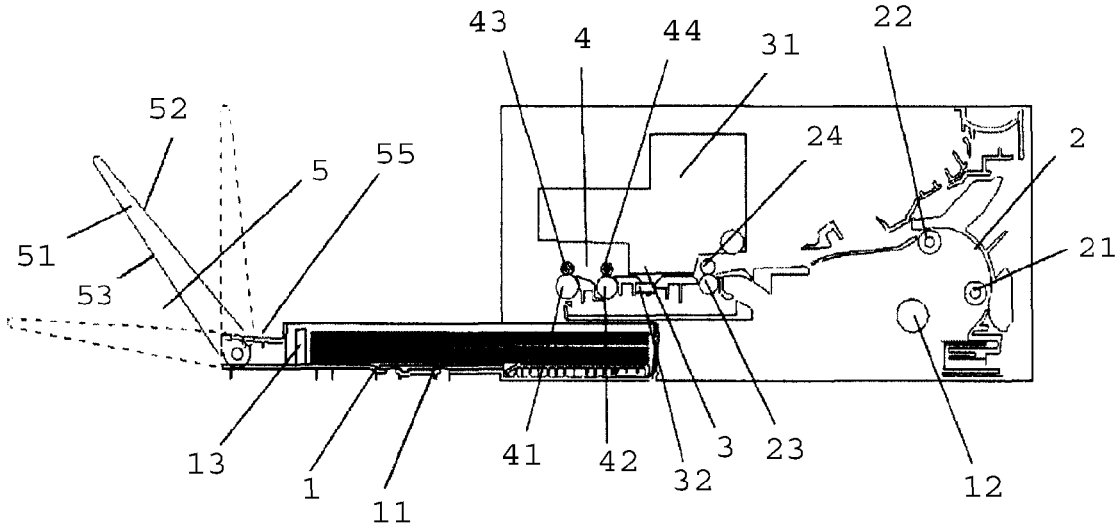
FIG. 5 is a schematic sectional view illustrating the state in which the tray of the recording device of FIG. 1 is drawn out.

Next, referring to FIG. 5, the method for setting recording sheets of a small size in the sheet feeder cassette 1 will be described.

The method for setting the recording sheets in the sheet feeder cassette 1 in this embodiment, which is structured as described above, is as follows: The sheet feeder cassette 1 can be slid out of the main assembly of the recording apparatus along with the tray 51, by sliding the tray 51 frontward of the main assembly. Thus, it is unnecessary to retract the tray 51 from the path of the sheet feeder cassette 1 when setting recording sheets in the sheet feeder cassette 1. In other words, this recording apparatus is excellent in terms of the efficiency with which a user can set recording sheets in the sheet feeder cassette 1.

Figure 6:
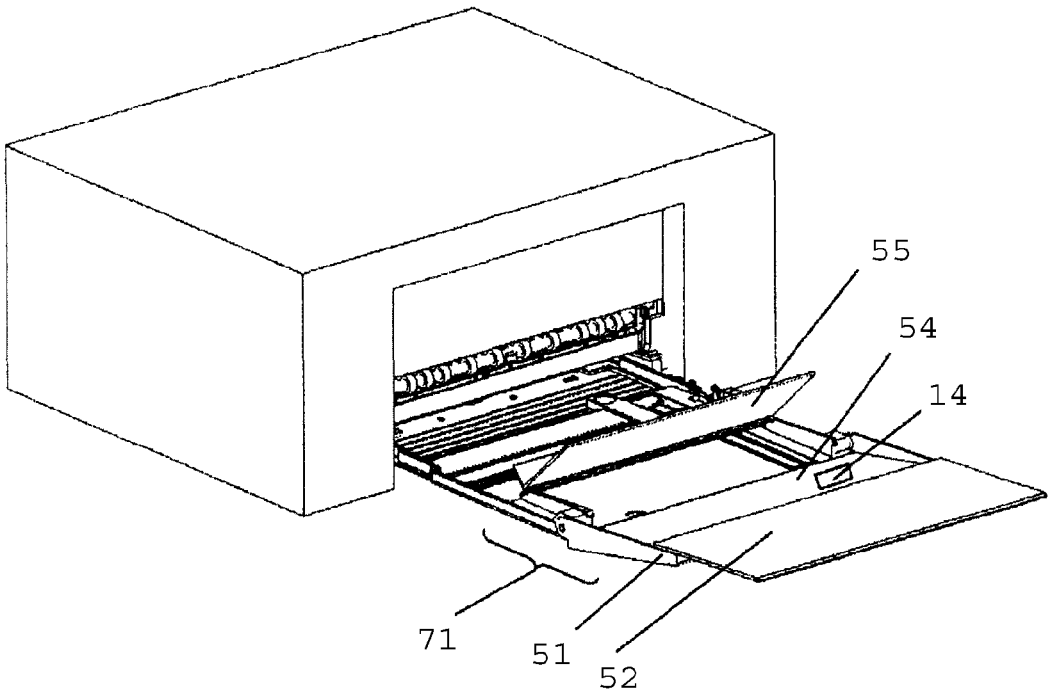
FIG. 6 is a perspective view of an outer appearance illustrating the state in which the tray of the recording device of FIG. 1 is drawn.

Next, referring to FIG. 6, the method for setting recording sheets of a large size in the sheet feeder cassette 1 with the use of the recording sheet supporting auxiliary portion 54, will be described.

Also in this case, first, the tray 51 is to be pulled out of the main assembly of the recording apparatus, by sliding the tray 51 frontward together with the sheet feeder cassette 1. Then, the discharged recording sheet holding portion 52 of the tray 51 is to be slid further frontward, and then, the discharged recording sheet catching plate 55 is to be rotationally moved, to create an opening 71, through which recording sheets can be inserted into the main assembly of the recording apparatus. As recording sheets of a large size are inserted into the main assembly, they are controlled in position by the recording sheet position controlling auxiliary plate 14, with which the sheet feeder cassette 1 is provided to control the recording sheets in their position in the cassette 1. The recording sheet position controlling auxiliary plate 14 controls in position the recording sheets by coming into contact with the trailing edge of each recording sheet. The sheet feeder cassette 1 is also provided with a regulating plate 13 (FIGS. 1 and 5), which can be folded flat on the bottom surface of the sheet feeder cassette 1, or removed, in order to prevent it from interfering with the mounting of recording sheets of a large size into the sheet feeder cassette 1. Further, sheet feeder cassette 1 is provided with an unshown handhold, which is on the front surface of the sheet feeder cassette 1. This handhold also can be folded flat, or removed, and is structured so that it can be manually operated, or is moved (laid flat or erected by the opening or closing movement of the tray 51. Thus, the handhold does not interfere with the mounting of the recording sheets of a large size.

As described above, the recording apparatus in this embodiment is structured so that the recording sheet supporting auxiliary portion 54 located inside the tray 5 also supports recording sheets by acting as an integral part of the recording sheet supporting primary portion 11 of the sheet feeder cassette 1. That is, the recording apparatus in this embodiment is structured so that the recording sheet supporting auxiliary portion 54, which is disposed in the tray 5, supports recording sheets in coordination with the recording sheet supporting primary portion 11 of the sheet feeder cassette 1. Thus, the sheet feeder cassette 1 and tray 5 are at virtually the same level. Thus, the recording apparatus in this embodiment is less in height than a conventional recording apparatus (recording apparatus in accordance with the prior art), by an amount equal to the amount by which the overall height of the combination of the sheet feeder cassette 1 and tray 5 can be reduced by disposing the sheet feeder cassette 1 and tray 5 at virtually the same level. In other words, the present invention can provide a recording apparatus which is significantly less in height than a conventional recording apparatus.

Further, the recording apparatus in this embodiment is structured so that the recording sheet supporting auxiliary portion 54 and recording sheet supporting primary portion 11 of the sheet feeder cassette 1 work in coordination with each other, acting like integral parts of a single component. Therefore, the recording apparatus can accommodate recording sheets which are large enough to protrude from the main assembly of the recording apparatus after they are mounted in the sheet feeder cassette 1. In other words, the present invention can provide a recording apparatus, whose front-to-rear dimension is significantly less than the size of a largest recording sheet usable with the recording apparatus. In the case of the recording apparatus in this embodiment, a recording sheet, the size of which is less than the front-to-rear dimension of the recording apparatus, is set on the recording sheet supporting primary portion 11 of the sheet feeder cassette 1, whereas a recording sheet, the size of which is greater than the front-to-rear dimension of the recording apparatus, is mounted on the combination of the recording sheet supporting primary portion 11 and recording sheet supporting auxiliary portion 54. As will be evident from the above given description of this embodiment, the present invention can provide a recording apparatus, the front-to-rear dimension of which is significantly less than the size of the largest recording sheet usable with the apparatus.

Also in the case of the recording apparatus in this embodiment structured as described above, a recording sheet of a large size is inserted into the space above the combination of the recording sheet supporting primary portion 11 and recording sheet supporting auxiliary portion 54, that is, the space which extends under the discharged recording sheet catching plate 55, across the recording sheet supporting primary portion 11 and recording sheet supporting auxiliary portion 54. Therefore, recording sheets can be stacked in the sheet feeder cassette 1 as high as the height of the space under the discharged recording sheet catching plate 55. As for a recording sheet of a smaller size, it is placed in the space which is directly above the recording sheet supporting primary portion 11, which is on the inward side of the discharged recording sheet catching portion 55. The recording sheet storage space in the main assembly of the recording apparatus, which corresponds in position to the recording sheet supporting primary portion 11, is greater in height than the space under the discharged recording sheet catching plate 55. Thus, in the case of the recording apparatus in this embodiment, the number by which recording sheets of a small size can be stored in the space above the recording sheet supporting primary portion 11 is not affected by the height of the space under the discharged recording sheet catching plate 55. In other words, the number by which recording sheets of a small size are storable in layers in the sheet feeder cassette 1 is equal to the maximum number by which recording sheets of a small size are storable in layers on the recording sheet supporting primary portion 11. As will be evident from the description of this embodiment, the recording apparatus in this embodiment is significantly smaller in size than a conventional recording apparatus, and yet, can accommodate recording sheets of a large size, while being the same as a conventional recording apparatus, in terms of the maximum number by which recording sheets of a small size are storable in layers in the sheet feeder cassette 1.

As will be evident from the above description of the recording apparatus in the first preferred embodiment of the present invention, the present invention can provide a recording apparatus which is significantly smaller in size than a conventional recording apparatus, and yet, is as satisfactory, or superior to, a conventional recording apparatus, in appearance, recording sheet capacity, and operability regarding the ease with which recording sheets can be set in the sheet feeder cassette 1.

(Embodiment 2)

Next, referring to FIGS. 7 and 8, the recording apparatus in the second preferred embodiment of the present invention will be described. The components of the recording apparatus in this embodiment, which are the same as, or similar to, the counterparts of the recording apparatus in the first preferred embodiment, which were described with reference to FIGS. 1-6, are given the same referential codes as those given to the counterparts, one for one, and will not be described here.

In the case of the first preferred embodiment, the recording sheet supporting secondary portion 54 was within the sheet feeder cassette 1, and was integrally used with the sheet feeder cassette 1 to accommodate recording sheets of a large size. However, the first preferred embodiment is not intended to limit the present invention in terms of recording apparatus structure.

Figure 7:
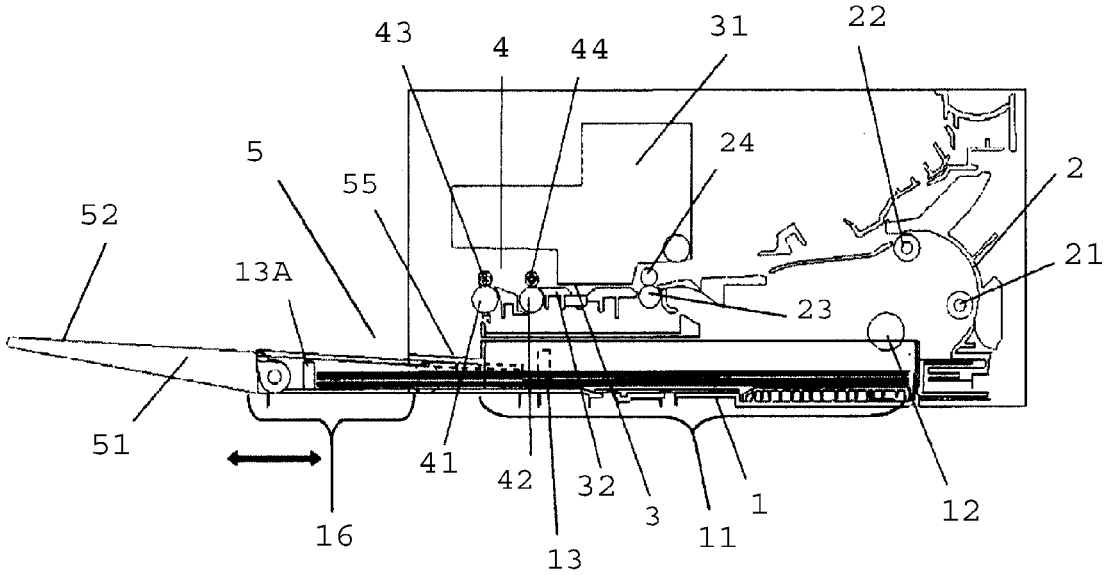
FIG. 7 is a schematic sectional view of a recording device according to a second embodiment of the present invention.
Figure 8:
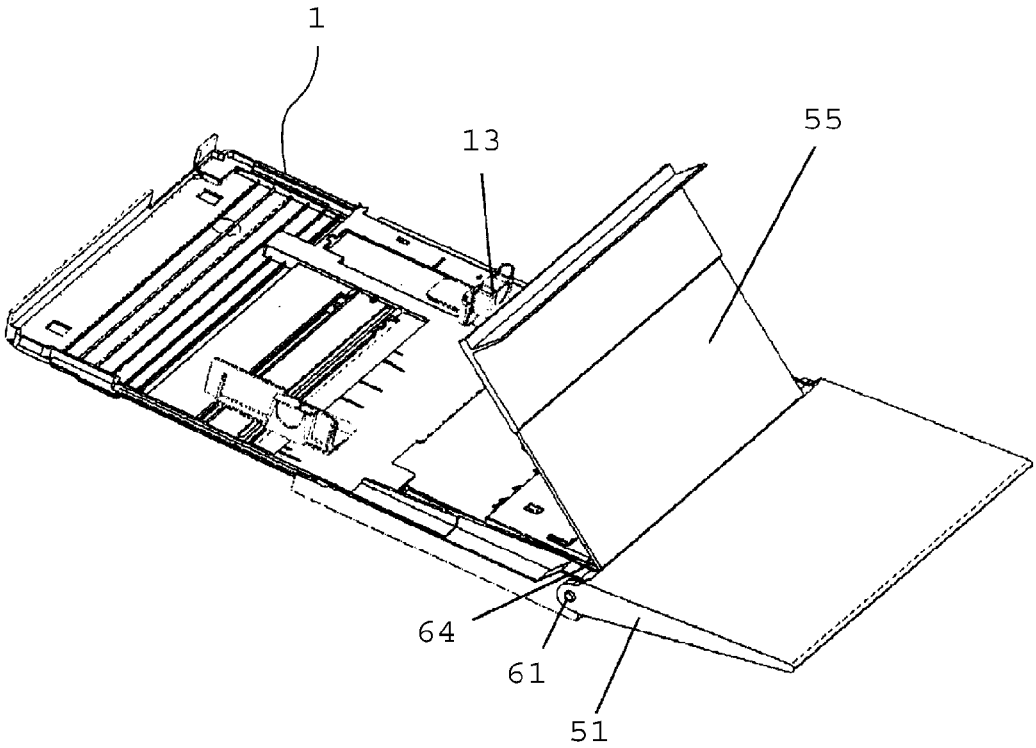
FIG. 8 is a perspective view illustrating a sheet feeding cassette used in the recording device of FIG. 7.

Referring to FIG. 7, the recording apparatus in this embodiment is provided with a multistage extension 16, which can increase in length the recording sheet supporting primary portion 11 of the sheet feeder cassette 1, in the direction parallel to the length of a recording sheet to be stored in layers in the sheet feeder cassette 1. That is, the sheet feeder cassette 1 in this embodiment is structured so that it can be adjusted in the length of the recording sheet supporting primary portion 11, according to the size of recording sheets to be stored in layers in the sheet feeder cassette 1. Further, the sheet feeder cassette 1 is structured so that as the recording sheet supporting primary portion 11 is increased in length, the discharged recording sheet catching plate 55 becomes longer, whereas as the recording sheet supporting primary portion 11 is reduced in length, the discharged recording sheet catching portion 55 becomes shorter. Further, the discharged sheet catching portion 5 in this embodiment is provided with an additional regulating plate 13A, which regulates, in position, each recording sheet by the trailing edge of the recording sheet, when recording sheets of a large size are stored in layers in the sheet feeder cassette 1 by lengthening the recording sheet supporting primary portion 11 of the sheet feeder cassette 1 with the use of the multistage extension 16.

Since the recording apparatus in this embodiment is structured as described above, it is also capable of storing in layers recording sheets of a large size, that is, recording sheets which are longer than the front-to-rear dimension of the main assembly of the recording apparatus, by the length of the extended extension 16, that is, the length of the extension 16 when the extension 16 is protruding from the sheet feeder cassette 1 as far as possible. That is, the front-to-rear dimension of this recording apparatus is significantly less than the largest recording sheet which can be accommodated by the recording apparatus. In the case of the recording apparatus in this embodiment, recording sheet, which are shorter than the front-to-rear dimension of the main assembly of the recording apparatus, are stored in the portion of the recording sheet storage space, which is directly above the recording sheet supporting primary portion 11, whereas recording sheets which are longer than the front-to-rear dimension of the main assembly of the recording apparatus, are stored in layers in the space above the combination of the recording sheet supporting primary portion 11 and extended extension 16. As will be evident from the above description of this embodiment of the present invention, the present invention can provide a recording apparatus, the front-to-rear dimension of which is significantly less than the size of the largest recording sheet which can be accommodated by the recording apparatus.

At this time, referring to FIG. 8, the method for setting recording sheets in the sheet feeder cassette 1 will be described.

When it is necessary to set recording sheets in the sheet feeder cassette 1, first, the discharged recording sheet catching plate 55 is to be rotated about the tray rotation axle 61. As the discharged sheet cutting plate 55 is rotated, the recording sheet storage space of the sheet feeder cassette 1 is exposed, making it easier to set recording sheets in the sheet feeder cassette 1. Incidentally, the recording apparatus is structured so that the recording sheet position regulating plate 13, with which the sheet feeder cassette 1 is provided, can be vertically extended or shortened, making it possible to reduce the regulating plate 13 in height to cause the regulating plate 13 to retract from the recording sheet supporting primary portion 11, and also, to increase the regulating plate 13 in height to regulate in position the trailing edge of each recording sheet when recording sheets of a small size are set.

As described above, the recording apparatus in this embodiment also is significantly smaller in size than a conventional recording apparatus, while being satisfactory in appearance, recording sheet capacity, and operability in terms of the ease with which recording sheets can be set in layers in its sheet feeder cassette.

(Embodiment 3)

Figure 9:
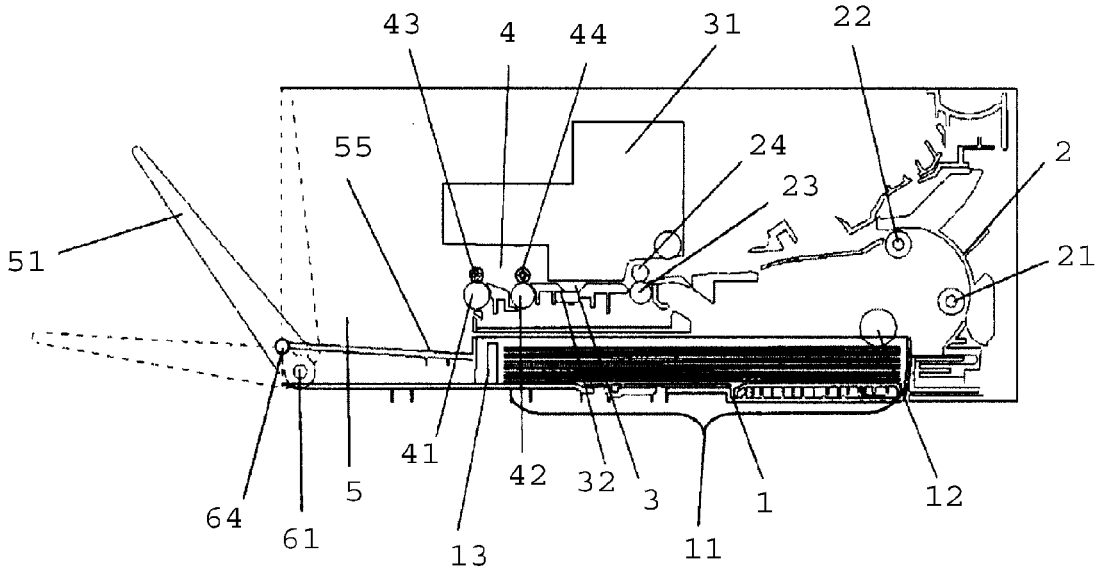
FIG. 9 is a schematic sectional view of a recording device according to a third embodiment of the present invention, wherein a sheet feeding cassette contains small size recording sheets.
Figure 10:
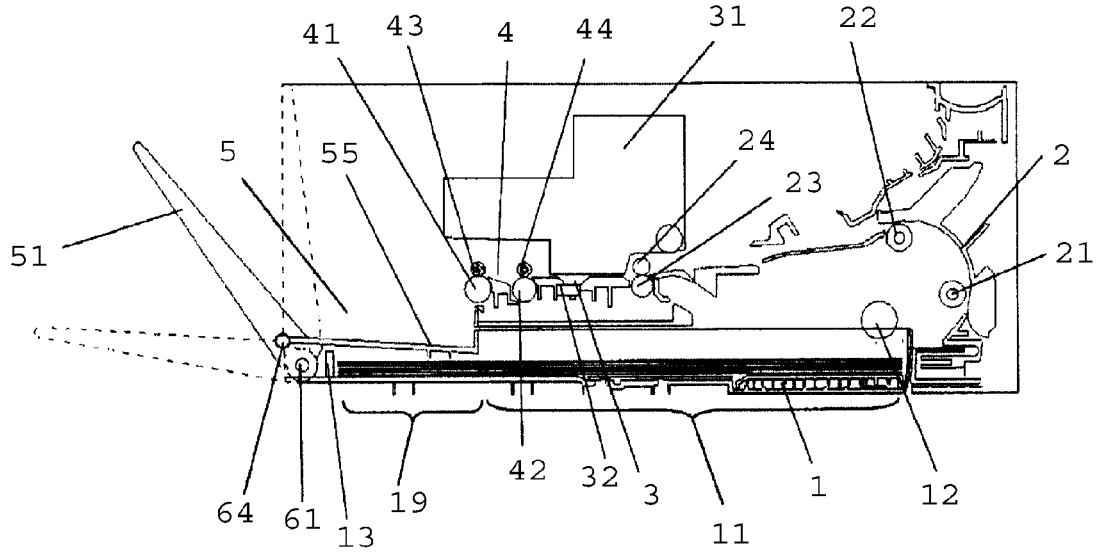
FIG. 10 is a schematic sectional view of the recording device according to the third embodiment of the present invention, wherein the sheet feeding cassette contains large size sheets.

Next, referring to FIGS. 9 and 10, the recording apparatus in the third preferred embodiment of the present invention will be described. The components of the recording apparatus in this embodiment, which are the same as, or similar to, the counterparts of the recording apparatus in the preceding preferred embodiments, which were described with reference to FIGS. 1-8, are given the same referential codes as those given to the counterparts, one for one, and will not be described here.

In the case of the first and second preferred embodiments of the present invention, the sheet feeder cassette 1 having the internal sheet supporting auxiliary portion 54, and the extendable sheet feeder cassette 1, are used to allow recording sheets, which are longer than the front-to-rear dimension of the main assembly of the recording apparatus, to be stored in layers in the sheet feeder cassette 1, by allowing the recording sheets to stretch outward beyond the external wall of the main assembly of the recording apparatus. However, the first and second embodiments of the present invention are not intended to limit the present invention in terms of recording apparatus structure.

The front-to-rear dimension of the recording apparatus in this embodiment is large enough to accommodate the largest recording sheet on which recording can be made by this recording apparatus. Referring to FIG. 9, in the case of this recording apparatus structured as will be described next, recording sheets of a small size are stored in layers on the recording sheet supporting primary portion 11, which is behind the discharged recording sheet catching plate 55. Next referring to FIG. 10, recording sheets of a large size are stored in layers in a space 19, which is the combination of the space on the recording sheet supporting primary portion 11 and the space under the discharged recording sheet catching plate 55.

The recording apparatus in this embodiment is significantly less in height than a conventional recording apparatus, while being just as satisfactory as, or superior to, a conventional recording apparatus, in appearance, recording sheet capacity, and also, operability regarding the ease with which recording sheets can be set in its sheet feeder cassette.

(Embodiment 4)

Next, referring to FIGS. 11 and 12, the recording apparatus in the fourth preferred embodiment of the present invention will be described. The components of the recording apparatus in this embodiment, which are the same as, or similar to, the counterparts of the recording apparatus in the preceding preferred embodiments, which were described with reference to FIGS. 1-10, are given the same referential codes as those given to the counterparts, one for one, and will not be described here.

In the case of the first and second preferred embodiments, the recording apparatuses were provided with only a single sheet feeder cassette 1, and the recording sheet supporting auxiliary portion 54 (FIG. 2) and extension 16 (17) are used as integral parts of the recording sheet supporting primary portion 11 in order to enable the recording apparatus to accommodate recording sheets of a large size. However, the first and second embodiments are not intended to limit the present invention in terms of the structure of a recording apparatus.

Figure 11:
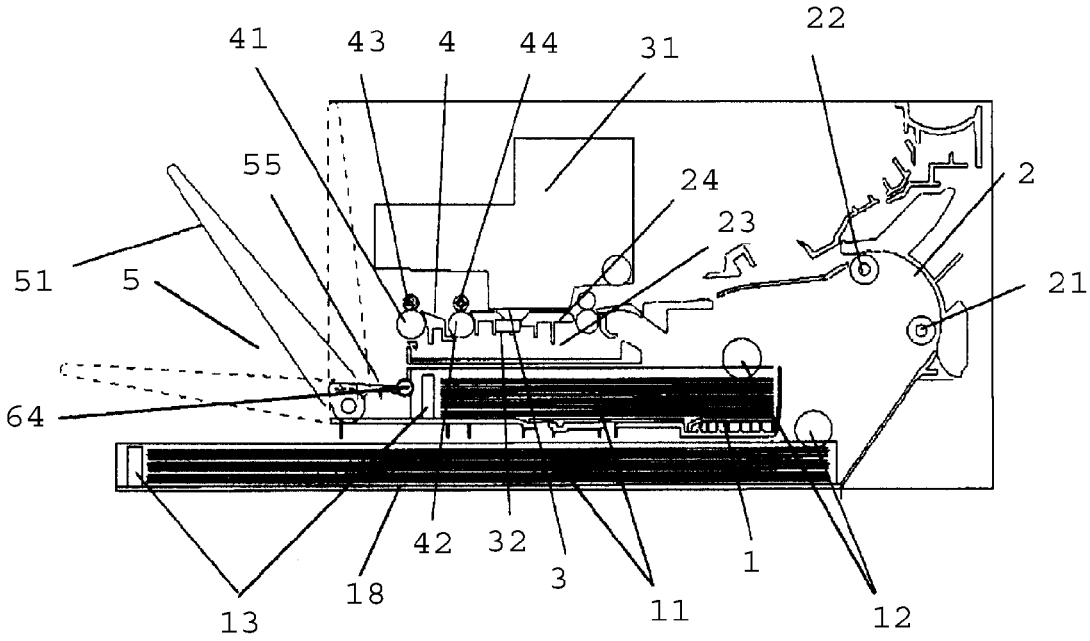
FIG. 11 is a schematic sectional view illustrating a recording device according to a fourth embodiment of the present invention, wherein an upper sheet feeding cassette contains small size sheets.

Referring to FIG. 11, the recording apparatus in this embodiment is structured to be usable with a pair of sheet feeder cassettes 1 and 18 which can be vertically stacked in the main assembly of the recording apparatus. The sheet feeder cassette 18, or the bottom cassette, is structured so that it can store in layers recording sheets of a large size. It extends beyond the front panel of the main assembly of the recording apparatus. From the standpoint of appearance and recording sheet capacity, the sheet feeder cassette 18 is desired to be structured so that it can be extended or shortened in multiple stages in the direction parallel to the direction in which a recording sheet is fed into the main assembly of the recording apparatus.

Figure 12:
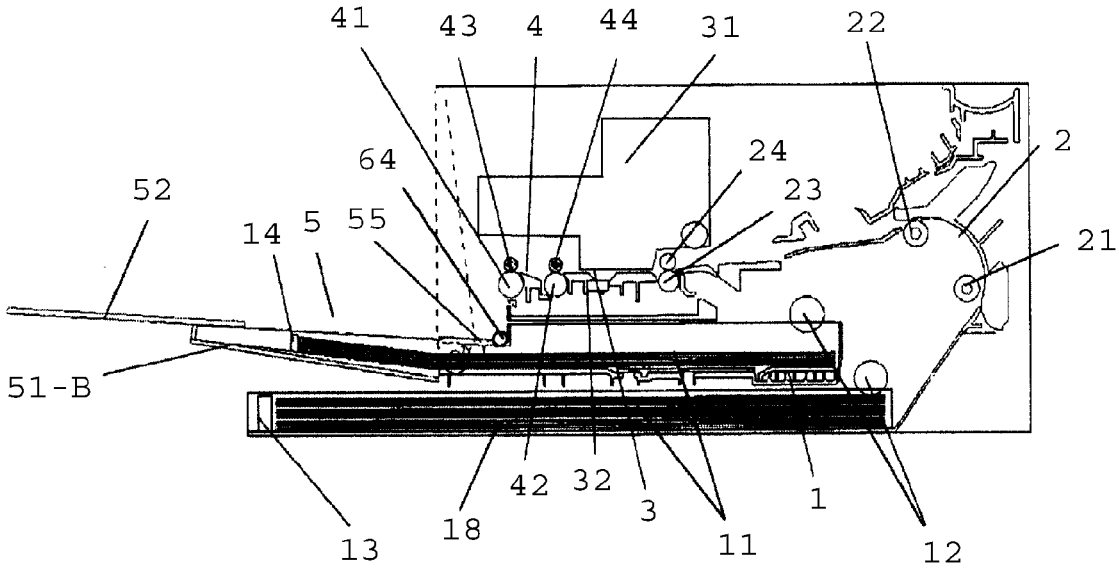
FIG. 12 is a schematic sectional view illustrating the recording device according to the fourth embodiment of the present invention, wherein the upper sheet feeding cassette contains large size sheets.

Next, referring to FIG. 12, the sheet feeder cassette 1, or the top sheet feeder cassette, is provided with a tray 51 having an internal recording sheet supporting auxiliary portion 54, which is rotatably attached to the cassette proper of the sheet feeder cassette 1 so that when recording sheets of a large size are used for recording, a part of each recording sheet is supported by the recording sheet supporting auxiliary portion 54 which is extending beyond the external wall of the main assembly of the recording apparatus. That is, in terms of this feature, this embodiment is the same as the first embodiment. However, it is not mandatory that the sheet feeder cassette 1, or the top sheet feeder cassette, is structured as described above. For example, the sheet feeder cassette 1 in this embodiment may also be provided with a multistage extension as is the sheet feeder cassette 1 in the second embodiment, so that a part of a recording sheet of a large size is supported outside the recording apparatus.

Further, in the case of this embodiment, recording sheets of a large size can be stored in layers in the sheet feeder cassette 18, that is, the bottom sheet feeder cassette. Therefore, the sheet feeder cassette 1, that is, the top sheet feeder cassette, may be structured to store in layers only recording sheets of a small size, or structured so that it can feed recording sheets of a large size as well. In a case where the sheet feeder cassette 1 (top cassette) is structured to store in layers only recording sheet of a small size, recording sheets are storable in layers only in the recording sheet space directly above the recording sheet supporting primary portion 11. In this case, therefore, recording sheets (of small size) can be stored in layers in the sheet feeder cassette 1 to its full capacity, regardless of the vertical position of the discharged recording sheet catching plate 55. As described above, the recording apparatus in this embodiment also is significantly smaller in size than a conventional recording apparatus, while being capable of accommodating recording sheets of a large size, and also, being the same in the maximum small recording sheet capacity (in sheet count) as a conventional recording apparatus.

As described above, the recording apparatus in this embodiment also is significantly smaller in size than a conventional recording apparatus, while being as satisfactory as, or superior to, a conventional recording apparatus, in appearance, recording sheet capacity, and operability in terms of the ease with which recording sheets can be set in its sheet feeder cassette.

(Embodiment 5)

Next, referring to FIGS. 13 and 14, the recording apparatus in the fifth preferred embodiment of the present invention will be described. The components of the recording apparatus in this embodiment, which are the same as, or similar to, the counterparts of the recording apparatus in the preceding preferred embodiments, which were described with reference to FIGS. 1-12, are given the same referential codes as those given to the counterparts, one for one, and will not be described here.

In the fourth preferred embodiment of the present invention, the recording apparatus was provided with a pair of sheet feeder cassettes which were vertically stacked in the main assembly of the recording apparatus, and also, was structured so that a part of a recording sheet can be supported outside the main assembly of the recording apparatus, by the recording sheet supporting auxiliary portion 54 (FIG. 2) and/or extension 16 (FIG. 7). However, the fourth embodiment is not intended to limit the present invention in terms of recording apparatus structure.

Figure 13:
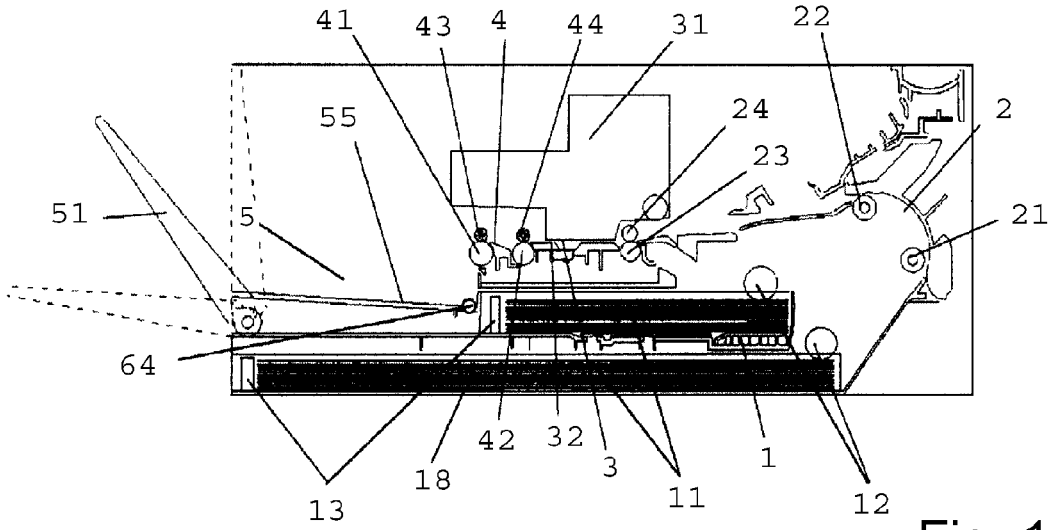
FIG. 13 is a schematic sectional view illustrating a recording device according to a fifth embodiment of the present invention, wherein the upper sheet feeding cassette contains small size sheets.
Figure 14:
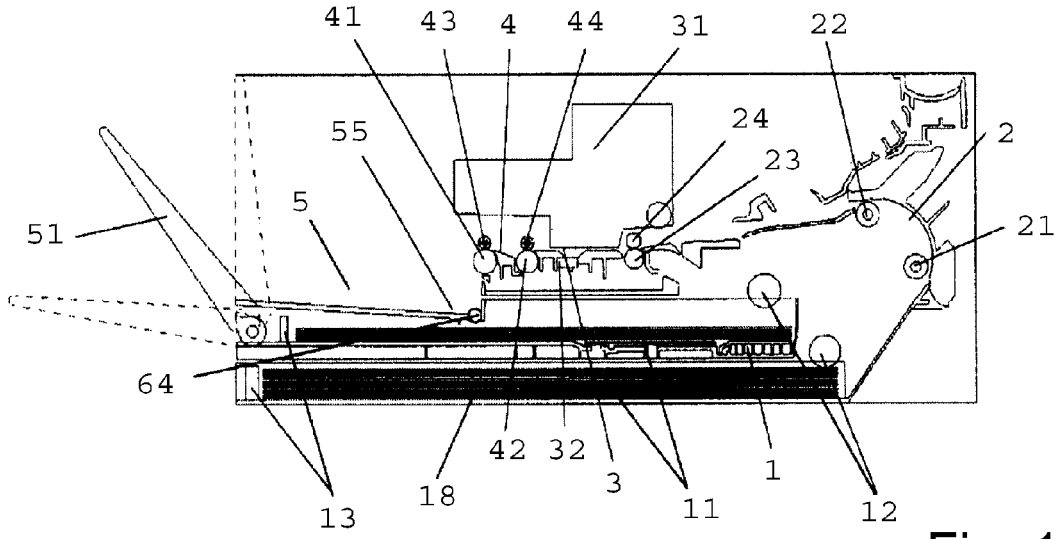
FIG. 14 is a schematic sectional view illustrating a recording device according to a fifth embodiment of the present invention, wherein an upper sheet feeding cassette contains large size sheets.
Figure 15:
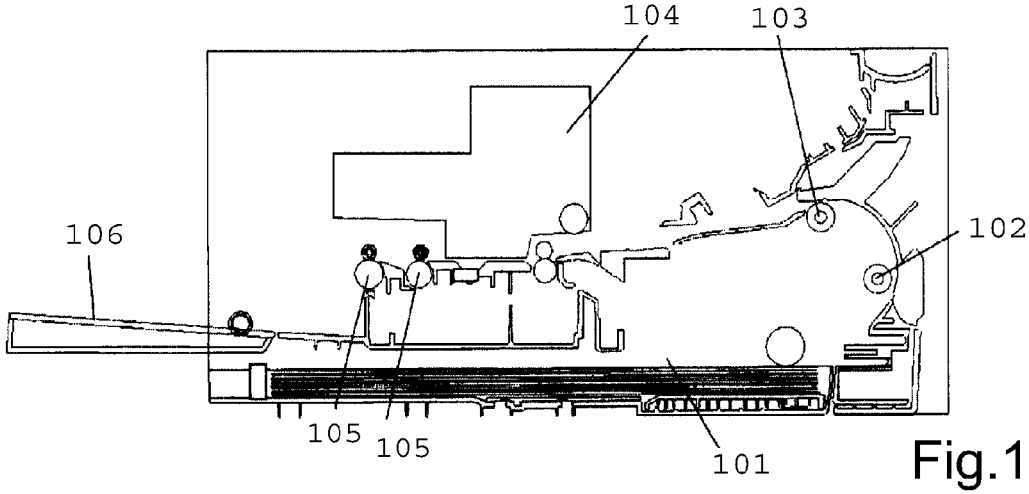
FIG. 15 is a schematic sectional view illustrating a conventional recording device.

Referring to FIGS. 13 and 14, in terms of the front-to-rear dimension, a recording apparatus may be structured so that recording sheets of the maximum size, which are stored in layers in the sheet feeder cassette 1 or 18, that is, the top or bottom cassette, do not extend beyond the front panel of the recording apparatus. In this embodiment, recording sheets of a small size are stored in layers in the storage space directly above the recording sheet supporting primary portion 11, which is behind the discharged recording sheet catching plate 55 of the sheet feeder cassette 1 (top cassette) as shown in FIG. 13, whereas recording sheets of a large size are stored in layers in the combination of the storage space directly above the recording sheet supporting primary portion 11, and the storage space directly below the discharged recording sheet catching plate 55.

The recording apparatus in this embodiment structured as described above also is significantly less in height than a conventional recording apparatus, while being satisfactory as, or superior to, a conventional recording apparatus in appearance, recording sheet capacity, and operability in terms of the ease with which recording sheets can be set in its sheet feeder cassette.

While the invention has been described with reference to the structures disclosed herein, it is not confined to the details set forth, and this application is intended to cover such modifications or changes as may come within the purposes of the improvements or the scope of the following claims.

What is claimed is:

1. A recording apparatus comprising:

a main assembly;

a cassette having a stacking region for stacking recording material to be subjected to a recording operation and mounted to said main assembly of the recording apparatus;

a feeder for feeding the recording material stacked in said cassette;

a sheet discharge portion having a discharge roller for discharging the recording material having been subjected to the recording operation; and a tray pivotally supported by said cassette, and movable between a first position where said tray covers said discharge roller and a second position where the recording material is capable of being discharged by said discharge roller, wherein said tray supports the recording material discharged by said discharge roller when said tray is at the second position.

2. An apparatus according to claim 1, wherein said stacking region is extensible in the length direction of recording material stacked on said tray.

3. An apparatus according to claim 1, wherein said tray is extensible by an extension member in the length direction of recording material stacked on said stacking region when said tray is at the second position.

4. An apparatus according to claim 1, wherein said tray is movable between the first position and the second position by rotating about a rotation axis.

5. An apparatus according to claim 1, wherein said tray is provided with a cover constituting an outer appearance of said main assembly of the recording apparatus when said tray is at the first position.

6. An apparatus according to claim 1, wherein the recording operation is effected by an ink jet recording head for ejecting ink onto the recording material.

7. An apparatus according to claim 1, further comprising an auxiliary portion located inside said tray and capable of stacking recording material to be subjected to the recording operation with said stacking region when said tray is at the second position.

8. An apparatus according to claim 7, wherein recording material discharged by said discharge roller is supported above said auxiliary portion when said tray is at the second position.

* * * * *